United States Patent [19]

Czarnecki

[11] Patent Number: 5,030,339

[45] Date of Patent: Jul. 9, 1991

[54] SEPARATION OF GAS AND OIL MIXTURES

[75] Inventor: Bogdan A. Czarnecki, Sale, United Kingdom

[73] Assignee: Costain Engineering Limited, Manchester, United Kingdom

[21] Appl. No.: 421,542

[22] Filed: Oct. 13, 1989

[30] Foreign Application Priority Data

Oct. 21, 1988 [GB] United Kingdom ..... 8824656

[51] Int. Cl.[5] ..... C10G 7/00

[52] U.S. Cl. ..... 208/351; 208/353; 208/354; 62/24; 62/31; 62/34

[58] Field of Search ..... 62/23, 24, 31, 34; 208/351, 353, 354

[56] References Cited

U.S. PATENT DOCUMENTS

| | | | |
|---|---|---|---|
| 3,791,156 | 2/1974 | Tracy et al. | 62/23 X |
| 4,270,939 | 6/1981 | Rowles et al. | 62/22 |
| 4,312,652 | 1/1982 | Mikulla | 208/351 X |
| 4,486,209 | 12/1984 | Fabbri et al. | 62/28 X |
| 4,622,053 | 11/1986 | Tomlinson et al. | 62/31 X |
| 4,702,819 | 10/1987 | Sharma et al. | 208/351 X |
| 4,710,214 | 12/1987 | Sharma et al. | 62/34 X |
| 4,711,651 | 12/1987 | Sharma et al. | 62/23 X |
| 4,846,863 | 7/1989 | Tomlinson et al. | 62/24 |

FOREIGN PATENT DOCUMENTS

| | | |
|---|---|---|
| 1257372 | 12/1971 | United Kingdom . |
| 2110808 | 6/1983 | United Kingdom . |
| 2129826 | 5/1984 | United Kingdom . |
| 2146751 | 4/1985 | United Kingdom . |

*Primary Examiner*—Helane E. Myers
*Assistant Examiner*—William C. Diemler
*Attorney, Agent, or Firm*—William C. Long

[57] ABSTRACT

In the separation of a compressed multi-component hydrocarbon stream containing liquid and gas phases to produce a liquid product stream having a specified maximum vapor pressure and a gas product stream having a specified maximum cricondenbar, gas flaring can be reduced and other advantages obtained by the method of (i) separating the liquid and gas phases in one or more separation stages at progressively reduced pressures to produce said liquid product stream, and (ii) treating the recovered gas phase to obtain the gas product stream by partial condensation of the recovered gas phase and separation of the condensate so formed; wherein (iii) step (ii) includes the step of rectifying the recovered gas phase in a refluxing exchanger and separating the condensate so formed.

4 Claims, 3 Drawing Sheets

SEPARATION OF GAS AND OIL MIXTURES

This invention relates to the separation of multi-component hydrocarbon mixtures into a liquid product stream having a desired maximum vapour pressure and a gas product stream having a desired maximum cricondenbar. By cricondenbar we mean the highest pressure at which liquids can form. The invention is particularly applicable to the separation of associated gases from wellhead gas/oil mixtures in oil and gas production.

According to the simplest, most frequently encountered method for the separation of gas and oil mixtures in a gas and oil separation plant (GOSP), two phase production from the wellhead is flashed, usually in a series of separator vessels which operate at progressively reduced pressures. The number and operating pressures of the vessels are optimised for maximum crude oil production from the last stage separator. This stage is always operated close to atmospheric pressure to produce a low vapour pressure crude oil which is suitable for storage and shipment, e.g. by road or sea tanker. Associated gases evolved during separation are used as fuel at the production unit and all the excess gas is flared.

Utilisation of associated gases from GOSP for other purposes, e.g. as fuel or in chemical processes, usually requires compression of the separator flash gases and pipelining over large distances. For a typical two stage process treating wellhead hydrocarbons with a gas-oil ratio (GOR) in the order of 1200 SCF/BBL, associated gas from the first separator, typically at about 13–17 bar a. is compressed in a high pressure gas turbine driven centrifugal compressor to about 36 bar a. Flash gases from the second stage, low pressure separator, typically at about 1.3 bar a. are compresed to 13–17 bar a. and form part of the feed to the high pressure gas compressor as described.

The high pressure compressed gas, however, contains substantial amounts of butanes and heavier hydrocarbons which can cause condensation in the pipe line, resulting in the need for large slug catchers and condensate removal equipment in the pipe line system, if not removed.

Conventional recovery of these condensibles is carried out by cooling and separating the associated gases to remove a substantial part of the heavier hydrocarbons from this stream. The incoming gas is dried or glycol inhibited and is then cooled in a series of heat exchangers against cold separator treated gas and recovered cold condensate and then in a refrigerated chiller against, e.g. vaporising Propane, Freon or NGL. The resulting two phase mixture is then separated in a cold condensate drum. The recovered cold gas is warmed by heat exchange with the feed, as is the cold condensate, and then pipelined as export gas. The rewarmed condensate is then fed to a condensate stabiliser, where it is fractionated into a liquid bottoms stream and a vapour overheads stream. The bottoms which contains $C_4+$ hydrocarbons and only a limited quantity of lighter hydrocarbons can be recycled to the low pressure separator.

The overheads from the condensate stabiliser containing the lighter hydrocarbons are used as fuel for the production process. However, this stream can be very much larger than the fuel required for production. The surplus cannot be compressed into the export gas, as it still contains significant quantities of $C_4+$hydrocarbons which would condense out in the pipe line. This stream is, therefore, normally sent to flare to be burnt. Alternatively a refrigerated condenser is installed on the overheads on the condensate stabiliser to minimise or eliminate flaring.

For most uses, the cricondenbar specification of the warm treated gas recovered from the cold condensate stream, i.e. the export gas, is generally 95 bar max. Typically, this gas is compressed to about 170 bar and is exported by pipe line as a single phase.

While the above-described method has gained wide acceptance in practice, there is a need for a more efficient alternative to minimise or eliminate gas flaring and reduce the weight and space requirements for recovery plants, particularly in off-shore production where large, expensive structures are required to accommodate processing equipment.

It has now been found that flaring and space/weight requirements can be substantially reduced by rectifying the uncondensed gas in a refluxing exchanger because this enables the separation to be performed over a whole temperature range of the rectification rather than just at the cold end in a single stage separation.

Thus, according to the present invention, there is provided a method of separating a compressed multi-component hydrocarbon stream containing liquid and gas phases to produce a liquid product stream having a specified maximum vapour pressure and a gas product stream having a specified maximum cricondenbar, the method comprising (i) separating the liquid and gas phases in one or more separation stages at progressively reduced pressures to produce said liquid product stream, and (ii) treating the recovered gas phase to obtain said gas product stream by partial condensation of said recovered gas phase and separation of the condensate so formed; wherein (iii) step (ii) includes the step of rectifying said recovered gas phase in a refluxing exchanger and separating the condensate so formed.

The refrigeration for the process may be provided by external refrigeration, preferably by use of a vapour compression refrigerator but alternatively by direct use of a cooling medium such as water or a water/glycol mixture.

Refrigeration for the process may also be provided from a process stream, e.g. by expansion of the rectified gas or condensed liquid.

In one embodiment which employs expansion of the rectified gas to provide refrigeration for the process, all or part of the gas recovered from the top of the refluxing exchanger may be passed back to provide refrigeration at the warm end of that exchanger and then work expanded and employed to provide refrigeration at the cold end of the exchanger. In another embodiment, the rectified gas may be expanded, isenthalpically or isentropically, and then passed back through the refluxing exchanger to provide, in one pass, refrigeration for both the cold and warm ends.

In one preferred embodiment of the invention, condensate from step (iii) is stripped and liquid bottoms from the stripper is included in the feed to at least one of, and preferably the last of, the separation stages of step (i).

Advantageously, this liquid bottoms may be used to warm said condensate prior to stripping it. The overheads from the stripper column may be used as fuel.

By means of this embodiment, further consequential benefits are obtainable, namely increased revenue from export gas;

increased revenue from crude oil production (up to 5% depending on the hydrocarbon feed stream composition);

substantially reduced heat load for the condensate stabilisation step, leading to a smaller stripper column and reboiler;

substantially reduced condensate recycle to the low pressure separator and thus reduced compression and utility requirements;

significantly reduced size of the refrigeration unit required to effect the separation;

significantly reduced size of ancilliary equipment required to provide services e.g. cooling water, steam etc.

The invention will now be described in more detail with reference to one embodiment thereof and with the aid of the accompanying drawings which are flow diagrams.

Referring to the drawings.

Figure 1:
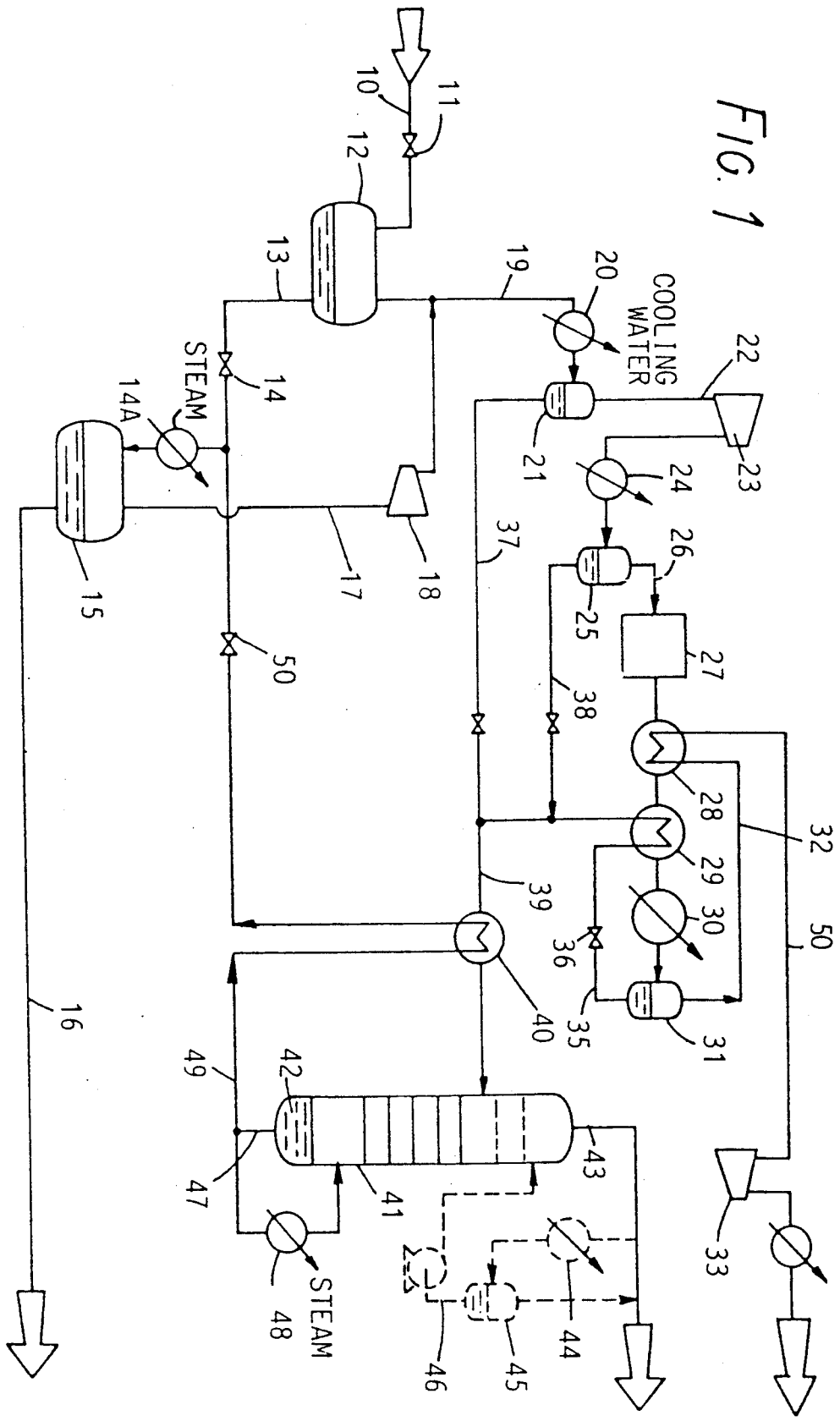
FIG. 1 is a flow diagram of a conventional plant for the separation of gas and oil mixtures.

In a gas/oil separation using the arrangement of FIG. 1, a crude feed stream supplied at high pressure through line 10 is expanded through expansion valve 11 into gas liquid HP separator 12. The liquid in HP separator 12 is recovered in line 13, further expanded through valve 14, heated in 14*a* and the gas/liquid mixture so formed fed into LP separator 15. The conditions of the LP separator are such that the liquid recovered in line 16 has substantially only higher hydrocarbons and a low enough vapour pressure to enable it to be safely piped as crude oil.

The vapour from the LP separator 15 is recovered in line 17 and, after compression in LP compressor 18, added to the vapour recovered from HP separator 12 in line 19.

The combined vapour stream in line 19 is cooled and partially condensed in cooler 20 and the condensed liquid and uncondensed gas are separated in a first intermediate separator 21. The uncondensed vapour is recovered in line 22 and is compressed in HP compressor 23, further cooled in cooler 24 and then the resultant partially condensed stream is fed into a second intermediate separator 25. The uncondensed vapour from this separator is recovered in line 26, passed through a drier 27 and further cooled by the two heat exchangers 28, 29 and by externally cooled refrigerator 30, in that order, to effect further condensation and leave a gas stream having the desired maximum cricondenbar for pipelining.

This gas is separated from the condensate in separator 31, recovered via a line 32 and warmed in heat exchanger 28 by indirect heat exchange with the dried feed stream in line 26. The resultant warmed gas, in line 50, is compressed by export compressor 33 and cooled by indirect heat exchange with water in after-cooler 34, so that it is of suitable temperature and pressure for export.

The condensate from separator 31 is recovered in line 35, expanded in valve 36 and warmed in heat exchanger 29, by indirect counter current heat exchange with the dried feed gas in line 26, before being combined with expanded condensates from the first and second intermediate separators 21, 25 carried in two lines, 37 and 38 respectively. The resultant expanded condensate mixture in line 39 is warmed in heat exchanger 40 before being fed to condensate stabiliser 41. There it is fractionated into a liquid bottoms stream 42 and a vapour overheads stream which is removed by line 43. This vapour stream contains lighter hydrocarbons and a part of the stream may be used as fuel for the production process. As the stream contains significant quantities of C4+hydrocarbons it cannot be compressed into the export gas and thus the remainder is normally sent to flare for burning. Optionally, to minimize flaring, a refrigerator 44 and separator 45 may be used to effect partial condensation of the overheads stream, the condensate being returned in line 46, after compression, to the condensate stabiliser 38.

The condensate stabiliser column bottoms 42 contain mainly $C_4$+hydrocarbons with a limited quantity of lighter hydrocarbons. The bottoms are recovered in line 47 and a part is revaporised in reboiler 48 and returned to the column as reboil, the remainder, in line 49, is cooled in heat exchanger 40 by indirect counter current heat exchange with the condensate stabiliser feed in line 39. The bottoms are then expanded through valve 50 and recycled to the LP separator 15.

Figure 2:
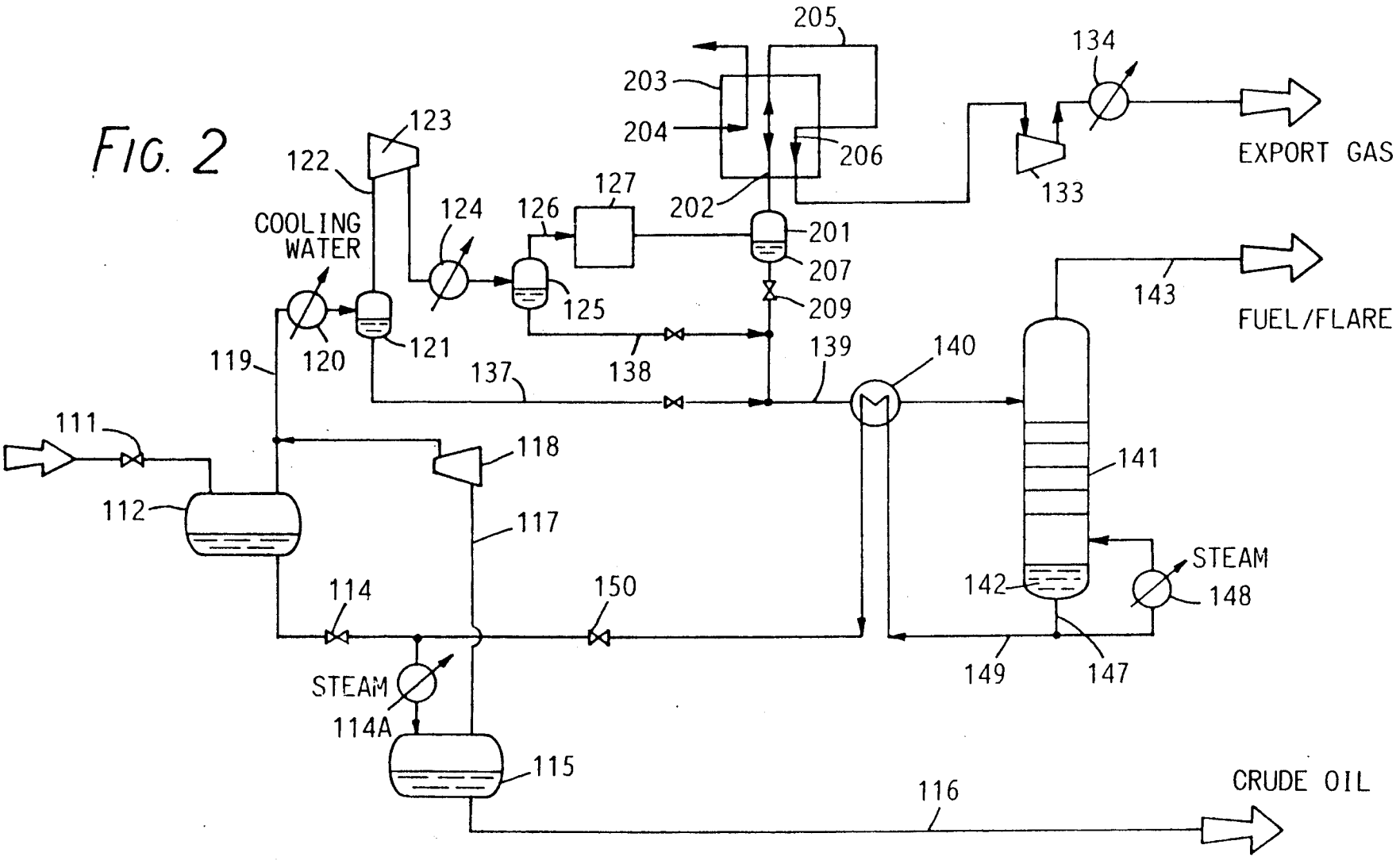
FIG. 2 is a flow diagram showing the modifications to the process according to one embodiment of the present invention wherein the gas/condensate separation is carried out in a refluxing exchanger.

The flow sheet for one apparatus according to the present invention is shown in FIG. 2. For simplicity, pipelines and equipment in FIG. 2 common with the arrangement of FIG. 1 are accorded the same reference numerals plus 100.

It can be seen that as in the conventional method, the major part of the heavier hydrocarbons are separated from the lighter components in HP and LP separators 112 and 115. Similarly, the vapour stream in line 119 resulting from this separation is treated, as before by sequential partial condensation and separation. However in the present arrangement, the heat exchangers 28 and 29 and externally cooled refrigerator 30 after the drier 27 on line 26 are replaced by a refluxing exchanger 203. Thus, the stream recovered from the drier 127 is fed, into gas/liquid separator 201 and the uncondensed gas in line 202 passes upwards in passages of the refluxing exchanger 203 where it is further cooled, initially by process stream 206, described below and then by externally supplied refrigerant passing through line 204. The condensate formed by this further cooling descends in line 202 in direct counter-current with and in intimate contact with the rising gas and returns to the gas liquid separator 201 where it mixes with the condensate therein. The gas recovered at the top of the refluxing exchanger in line 205 is high in methane and typically contains little $C_4$+ hydrocarbon. This gas is passed back, in line 206, through further passages of the refluxing exchanger in the warm end thereof to cool the incoming gas in passages 202 and thence to an export compressor 133 and after-cooler 134 from whence it is recovered at a suitable pressure and temperature for export as a sales gas.

The condensate 207 in gas/liquid separator 201 is withdrawn in line 208, expanded through valve 209 and combined with the stream in line 138 which is expanded condensate from the second intermediate separator 125. The combined stream is then combined with the expanded condensate in line 137 which is recovered from the first intermediate separator 121 and the resultant stream then stripped in the conventional manner described with reference to FIG. 1 to recover a gas suitable for use as fuel in line 143 and a bottoms which is expanded through valve 150 and then fed to LP separator 115.

Use of a refluxing exchanger in the method of the present invention permits a high level of separation of export gas and crude oil while minimizing the quantity of waste gas.

Depending on the composition of the stream in line 205/206, its critical pressure may be such as to permit the refluxing exchanger to be operated at a sufficiently high pressure that the refrigeration may be provided by chilled water or even water at ambient temperature.

Figure 3:
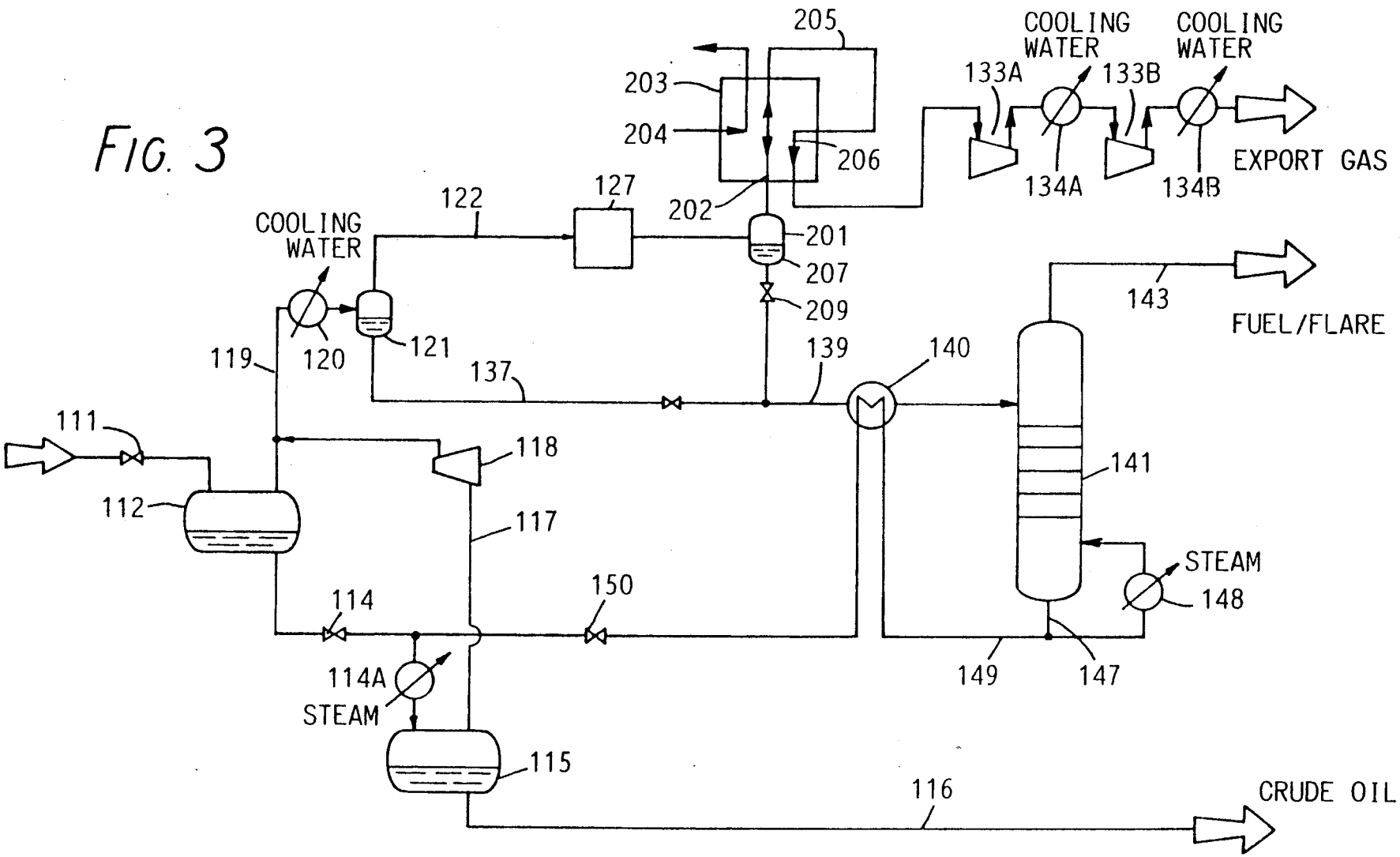
FIG. 3 is a flow diagram illustrating another embodiment of the process of the present invention.

If desired, in an alternative embodiment the refluxing exchanger 203 may be operated at the discharge pressure of the low pressure compressor 118. In this embodiment, which is illustrated in FIG. 3, the stream in line 122 is fed direct to drier 127 and the compressor 123, after-cooler 124 and separator 125 are omitted. Export compressor 133 is then required to raise the gas in line 205/206 from the discharge pressure of low pressure compressor 118 to the export pressure. In the embodiment illustrated in FIG. 3, the export compressor requirements are provided by two compressors 133A and 133B with associated after-coolers 134A and 134B.

By way of Example, a feed stream comprising a gas/oil mixture was subjected to separation by the process described above with reference to FIG. 2 to yield export gas, fuel/flare gas and crude oil.

The compositions, temperatures and pressures of the various pressure streams are given in Table 1 below.

By way of comparison the same feed, provided at the same temperature and pressure was treated by the process described with reference to FIG. 1. The compositions, temperatures and pressures of the various process streams are given in Table 2 below.

TABLE 1

| STREAM: | Feed | Vapour from Separator 112 | Liquid from Separator 112 | Crude Oil Product (116) | 117 before Compression in 118 | 117 after Compression in 118 |
|---|---|---|---|---|---|---|
| Name | | | | | | |
| Temperature °C. | 70 | 70 | 70 | 47 | 47 | 154 |
| Pressure Kpa a | 1800 | 1800 | 1800 | 130 | 130 | 1800 |
| Molar Flow kg mole/hr | 4612 | 2996 | 1615 | 1549 | 722 | 722 |
| Mass flow kg/hr (to nearest 50) | 331250 | 73150 | 258100 | 261600 | 37650 | 37650 |
| H2O | 0.5% | 0.7% | 0.1% | 0% | 0.4% | 0.4% |
| CO2 | 1.7% | 2.5% | 0.4% | 0% | 1.0% | 1.0% |
| Methane | 47.6% | 70.7% | 4.7% | 0.1% | 11.3% | 11.3% |
| Ethane | 8.3% | 11.4% | 2.8% | 0.3% | 10.3% | 10.3% |
| Propane | 6.1% | 6.9% | 4.4% | 1.7% | 21.1% | 21.1% |
| Butanes | 5.3% | 4.4% | 6.9% | 7.6% | 31.5% | 31.5% |
| Pentanes | 3.7% | 1.8% | 7.1% | 10.4% | 14.7% | 14.7% |
| Higher Boiling Hydrocarbons | balance | balance | balance | balance | balance | balance |

| STREAM: | Feed to Separator 121 | 122 before Compression in 123 | 122 after Compression in 123 and cooling in 124 | 126 after Drying in 127 | 205 | (206) at inlet to Compressor 133 |
|---|---|---|---|---|---|---|
| Temperature °C. | 30 | 30 | 30 | 30 | 5.4 | 25.4 |
| Pressure Kpa a | 1750 | 1750 | 3500 | 3500 | 3480 | 3450 |
| Molar Flow kg mole/hr | 3718 | 3260 | 3260 | 3080 | 2874 | 2874 |
| Mass flow kg/hr (to nearest 50) | 110850 | 82900 | 82900 | 74000 | 63950 | 63950 |
| H2O | 0.6% | 0.3% | 0.3% | 0% | 0% | 0% |
| CO2 | 2.2% | 2.4% | 2.4% | 2.5% | 2.6% | 2.6% |
| Methane | 59.2% | 66.6% | 66.6% | 69.7% | 73.6% | 73.6% |
| Ethane | 11.2% | 12.0% | 12.0% | 12.1% | 12.2% | 12.2% |
| Propane | 9.7% | 9.2% | 9.2% | 8.7% | 7.9% | 7.9% |
| Butanes | 9.6% | 7.0% | 7.0% | 5.6% | 3.6% | 3.6% |
| Pentanes | 4.3% | 1.9% | 1.9% | 1.1% | 0.1% | 0.1% |
| Higher Boiling Hydrocarbons | balance | balance | balance | 0.3% | nil | nil |

| STREAM: | Condensate from Separator 201 | Combined Condensates from Separators 125 and 201 | Feed to Column 141 | Fuel/Flare (143) | 149 as recovered from bottom of column 141 | 149 before expansion through 150 |
|---|---|---|---|---|---|---|
| Temperature °C. | 28.4 | 29 | 50 | 48.7 | 86 | 55.7 |
| Pressure Kpa a | 3490 | 3490 | 1720 | 1680 | 1720 | 1690 |
| Molar Flow kg mole/hr | 206 | 384 | 826 | 171 | 656 | 665 |
| Mass flow kg/hr (to nearest 50) | 10150 | 18950 | 46650 | 5450 | 41200 | 41200 |
| H2O | 0% | 1.1% | 0.5% | 1.7% | 0.2% | 0.2% |
| CO2 | 1.0% | 1.0% | 0.7% | 2.5% | 0.3% | 0.3% |
| Methane | 14.6% | 14.3% | 10.1% | 45.0% | 1.0% | 1.0% |
| Ethane | 10.1% | 9.9% | 7.5% | 16.6% | 5.2% | 5.2% |
| Propane | 20.4% | 19.8% | 16.4% | 16.4% | 16.4% | 16.4% |
| Butanes | 34.9% | 33.2% | 31.1% | 13.4% | 35.7% | 35.7% |
| Pentanes | 15.1% | 15.2% | 19.0% | 3.4% | 23.0% | 23.0% |
| Higher Boiling Hydrocarbons | balance | balance | balance | balance | balance | balance |

TABLE 2

| STREAM: | Vapour from Separator 12 | Liquid from Separator 12 | Crude Oil Product (16) | 17 before Compression in 18 | 17 after Compression in 18 |
|---|---|---|---|---|---|
| Name | | | | | |
| Temperature °C. | 70 | 70 | 47 | 47 | 153 |
| Pressure Kpa a | 1800 | 1800 | 130 | 130 | 1800 |
| Molar Flow kg mole/hr | 2996 | 1615 | 1546 | 822 | 822 |
| Mass flow kg/hr (to nearest 50) | 73150 | 258100 | 261350 | 43300 | 43300 |
| H2O | 0.7% | 0.1% | 0% | 0.4% | 0.4% |
| CO2 | 2.5% | 0.4% | 0% | 0.9% | 0.9% |
| Methane | 70.7% | 4.7% | 0.1% | 9.6% | 9.6% |
| Ethane | 11.4% | 2.8% | 0.3% | 10.1% | 10.1% |
| Propane | 6.9% | 4.4% | 1.9% | 22.8% | 22.8% |
| Butanes | 4.4% | 6.9% | 7.8% | 32.5% | 32.5% |
| Pentanes | 1.8% | 7.1% | 10.0% | 14.1% | 14.1% |
| Higher Boiling Hydrocarbons | balance | balance | balance | balance | balance |

| STREAM: | Feed to Separator 21 | 22 before Compression in 23 | 22 after Compression in 23 and Coding in 24 | 26 after Drying in 27 | 32 | Export gas (5) at inlet to Compressor 33 |
|---|---|---|---|---|---|---|
| Temperature °C. | 30 | 30 | 30 | 30 | 6 | 20 |
| Pressure Kpa a | 1750 | 1750 | 3500 | 3500 | 3450 | 3420 |
| Molar Flow kg mole/hr | 3819 | 3289 | 3289 | 3093 | 2792 | 2792 |
| Mass flow kg/hr (to nearest 50) | 116500 | 84400 | 84400 | 74800 | 61400 | 61400 |
| H2O | 0.6% | 0.3% | 0.3% | 0% | 0% | 0% |
| CO2 | 2.1% | 2.4% | 2.4% | 2.5% | 2.6% | 2.6% |
| Methane | 57.6% | 65.8% | 65.8% | 69.1% | 74.7% | 74.7% |
| Ethane | 11.1% | 12.0% | 12.0% | 12.2% | 12.0% | 12.0% |
| Propane | 10.3% | 9.8% | 9.8% | 9.1% | 7.3% | 7.3% |
| Butanes | 10.4% | 7.3% | 7.3% | 5.8% | 3.1% | 3.1% |
| Pentanes | 4.5% | 1.8% | 1.8% | 1.0% | 0.3% | 0.3% |
| Higher Boiling Hydrocarbons | balance | balance | balance | balance | balance | balance |

| STREAM: | 35 after Expansion through 36 & warming in 29 | Combined Condensates from Separators 25 and 31 | Feed to Column 41 | Fuel/Flare (43) | 49 as recovered from bottom of column 41 | 49 before expansion through 50 |
|---|---|---|---|---|---|---|
| Temperature °C. | 18 | 20 | 46.9 | 46.4 | 86 | 55.7 |
| Pressure Kpa a | 1700 | 1700 | 1670 | 1680 | 1720 | 1690 |
| Molar Flow kg mole/hr | 301 | 493 | 1008 | 254 | 754 | 754 |
| Mass flow kg/hr (to nearest 50) | 13450 | 22950 | 54750 | 8200 | 46550 | 46550 |
| H2O | 0% | 0.9% | 0.5% | 1.3% | 0.2% | 0.2% |
| CO2 | 1.3% | 1.2% | 0.8% | 2.5% | 0.3% | 0.3% |
| Methane | 17.7% | 16.3% | 11.2% | 43.0% | 0.5% | 0.5% |
| Ethane | 13.6% | 12.1% | 8.8% | 17.9% | 5.6% | 5.6% |
| Propane | 26.2% | 23.8% | 18.9% | 18.3% | 19.1% | 19.1% |
| Butanes | 30.9% | 31.3% | 30.9% | 13.2% | 36.8% | 36.8% |
| Pentanes | 8.1% | 10.5% | 16.1% | 2.8% | 20.5% | 20.5% |
| Higher Boiling Hydrocarbons | balance | balance | balance | balance | balance | balance |

Comparison of the above data shows the following benefits achieved by the process of the present invention:

about 4 wt % increase in yield of export gas;

reduction of $C_5$+ hydrocarbons in export gas from 0.3% to 0.1%;

about 4% reduction in liquid product of level of hydrocarbons having 4 or less carbon atoms, i.e. an increase in the quality of the export crude oil.

about 30% reduction in the refrigeration requirements at the coldest point in the process, due to the reduced amount of condensate produced from the refluxing exchanger.

a reduction in the liquid content of the feed to the stabiliser column, thus reducing the heat load on the column by about 20%.

about 15% reduction in the size of the condensate recycle stream 49 (149) to the low pressure separator and hence the compression energy requirements for both the LP and HP compressors.

about 33 wt % reduction in the amount of total gas sent to fuel/flare.

In addition, the replacement of the heat exchagers 28,29,30 by the single refluxing exchanger 203 provides a significant reduction in the size of the unit required to effect the separation.

It will also be noted that the total amount of cooling water required for process cooling is also significantly reduced, leading to additional savings in the sizes of the ancilliary equipment.

What is claimed is:

1. In a process for separating a compressed multicomponent hydrocarbon stream containing liquid and gas phases to produce a liquid product stream having a specified maximum vapour pressure, a gas product stream having a specified maximum cricondenbar, and a further gas stream containing $C_4$ + hydrocarbons, the method of reducing the amount of said further gas stream which comprises:

(i) separating the liquid and gas phases in one or more separation stages at progressively reduced pressures to produce said liquid product stream, and (ii) treating the recovered gas phase to obtain said gas product stream by partial condensation of said recovered gas phase and separation of the condensate so formed; wherein (iii) step (ii) includes the step of rectifying said recovered gas phase in a refluxing exchanger, separating the condensate so formed, and recovering said further gas stream from the condensate.

2. A method as claimed in claim 1 which further includes stripping condensate obtained from said rectification step (iii) to recover said further gas stream overhead, and including liquid bottoms from the stripping step in the feed to at least one of the separation stages of step (i).

3. A method as claimed in claim 2 in which said liquid bottoms is included in the feed to the last of said separation stages.

4. A method as claimed in claim 1 wherein said multicomponent hydrocarbon stream comprises a wellhead gas/oil mixture, said liquid product stream comprises crude oil and said gas product stream comprises methane, ethane and propane substantially free of hydrocarbon containing four or more carbon atoms.

* * * * *